US006616548B2

(12) United States Patent
Kato et al.

(10) Patent No.: US 6,616,548 B2
(45) Date of Patent: Sep. 9, 2003

(54) TWO-PIECE SOLID GOLF BALL

(75) Inventors: Akira Kato, Kobe (JP); Takashi Sasaki, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 09/970,919

(22) Filed: Oct. 5, 2001

(65) Prior Publication Data

US 2002/0065150 A1 May 30, 2002

(30) Foreign Application Priority Data

Oct. 6, 2000 (JP) ..... 2000-307545

(51) Int. Cl.[7] ..... A63B 37/06
(52) U.S. Cl. ..... 473/371; 473/377; 473/378
(58) Field of Search ..... 473/351, 367, 473/368, 371, 377, 378

(56) References Cited

U.S. PATENT DOCUMENTS 4,968,038 A * 11/1990 Yamada ..... 273/DIG. 22
5,098,105 A * 3/1992 Sullivan ..... 260/998.14
5,516,110 A * 5/1996 Yabuki et al. ..... 273/DIG. 22
5,559,188 A * 9/1996 Egashira et al. ..... 473/385
5,645,496 A 7/1997 Endo et al.
5,663,235 A * 9/1997 Tanaka ..... 473/372
5,824,740 A * 10/1998 Yabuki et al. ..... 473/372
5,848,943 A * 12/1998 Sano et al. ..... 473/365
5,857,926 A * 1/1999 Sullivan et al. ..... 273/DIG. 22
5,965,669 A * 10/1999 Cavallaro et al. ..... 473/372

FOREIGN PATENT DOCUMENTS

| | | |
|---|---|---|
| GB | 2 316 875 | 3/1988 |
| JP | 63-220889 | 9/1988 |
| JP | 10-127823 | 5/1998 |

* cited by examiner

*Primary Examiner*—Mark S. Graham
*Assistant Examiner*—Raeann Gorden
(74) *Attorney, Agent, or Firm*—Birch, Stewart, Kolasch & Birch, LLP

(57) ABSTRACT

The present invention provides a two-piece solid golf ball having long flight distance, high spin amount at approach shot and excellent controllability, while maintaining good shot feel. The present invention relates to a two-piece solid golf ball comprising a core and a cover covering the core, wherein a surface hardness in Shore D hardness of the core is higher than a center hardness in Shore D hardness of the core by 15 to 40, the cover is formed from a cover composition comprising a blend of ionomer resin and high rebound characteristics thermoplastic elastomer, the cover has a Shore D hardness of 40 to 60, and the cover hardness is lower than the surface hardness of the core by 1 to 20.

3 Claims, 2 Drawing Sheets

TWO-PIECE SOLID GOLF BALL

FIELD OF THE INVENTION

The present invention relates to a two-piece solid golf ball. More particularly, it relates to a two-piece solid golf ball having long flight distance when hit by a middle iron club to a driver, large spin amount when hit by a short iron club and the like and excellent controllability, while maintaining good shot feel as good as thread wound golf ball.

BACKGROUND OF THE INVENTION

Golf balls having various structures are commercially selling. There are generally solid golf balls represented by two-piece golf ball and thread wound golf balls for round games. The two-piece solid golf balls have excellent flight performance and durability as compared with the thread wound golf balls. Therefore the two-piece solid golf balls occupy the greater part of the golf ball market. However, the two-piece solid golf ball is inferior to the thread wound golf ball in shot feel and controllability at approach shot.

There has been many suggestions in order to further improve performances of the two-piece solid golf ball. For example, in Japanese Patent Kokai publication Nos. 220889/1988, 98949/1994, 194732/1995 and the like, a two-piece solid golf ball, of which performances, such as flight distance (rebound characteristics), durability, shot feel and controllability are improved by mainly adjusting hardness or hardness distribution of the core to a proper range, is suggested. In Japanese Patent Kokai publication No. 127823/1998, a two-piece solid golf ball, of which performances are improved by adjusting thickness and hardness of the cover, and hardness distribution of the golf ball to proper ranges, is suggested.

In Japanese Patent Kokai publication No. 220889/1988, a two-piece solid golf ball having a hardness distribution in JIS-C hardness such that a hardness at the distance of less than 10 mm from the center point of the core is within the range of 60 to 79 and a hardness at the distance of more than 10 mm from the center point is within the range of 80 to 90; a thickness of the cover of 1.5 to 2.0 mm; and a deformation amount of the golf ball of 1.9 to 2.4 mm when applying from an initial load of 10 kgf to a final load of 130 kgf; is disclosed. However, in the golf ball, it is problem that the deformation amount of the golf ball is small, that is, the golf ball is hard, and its shot feel is poor.

In Japanese Patent Kokai publication No. 98949/1994, a two-piece solid golf ball having a hardness distribution of the core such that a hardness of the core is higher in order at the center point of the core, at the distance of 5 to 10 mm from the center point, at the distance of 15 mm from the center point and at the surface of the core is disclosed. However, in the golf ball, the cover is formed from relatively hard material, and its flight distance is long, but it is problem that its spin amount when hit by a short iron club and the like is small, which degrades its controllability.

In Japanese Patent Kokai publication No. 194732/1995, a two-piece solid golf ball having a center hardness in JIS-C hardness of the core of 40 to 57, a surface hardness in JIS-C hardness of the core of 70 to 95, and a difference between the surface hardness and center hardness of 20 to 40 is disclosed. However, also in the golf ball, the cover is formed from relatively hard material, and it is problem that its spin amount when hit by a short iron club and the like is small, which degrades its controllability.

In Japanese Patent Kokai publication No. 127823/1998, a two-piece solid golf ball having a thickness of the cover of 1.0 to 2.1 mm, which is thin; a JIS-C hardness of the cover of 75 to 95; and a hardness distribution such that a difference between the cover hardness and a center hardness in JIS-C hardness of the core is not more than 10, which is small; is disclosed. However, in the golf ball, the cover is formed from only ionomer resin, and it is problem that its rebound characteristics is poor, and its flight distance when hit by a driver is short.

It is required to provide a two-piece golf ball having excellent flight performance, good shot feel and controllability by solving the problems. Recently, multi-piece solid golf balls having excellent flight performance, good shot feel and controllability, as compared with a conventional two-piece solid golf ball, are developed. Therefore it is required to further improve the flight performance, shot feel and controllability also in the two-piece golf ball.

OBJECTS OF THE INVENTION

A main object of the present invention is to provide a two-piece solid golf ball having long flight distance when hit by a middle iron club to a driver, large spin amount when hit by a short iron club and the like and excellent controllability, while maintaining good shot feel as good as thread wound golf ball.

According to the present invention, the object described above has been accomplished by employing a blend of ionomer resin and high rebound characteristics thermoplastic elastomer in the cover, and adjusting the hardness distribution of the core and golf ball to specified ranges, thereby providing a two-piece solid golf ball having long flight distance when hit by a middle iron club to a driver, large spin amount when hit by a short iron club and the like and excellent controllability, while maintaining good shot feel as good as thread wound golf ball.

SUMMARY OF THE INVENTION

Figure 1:
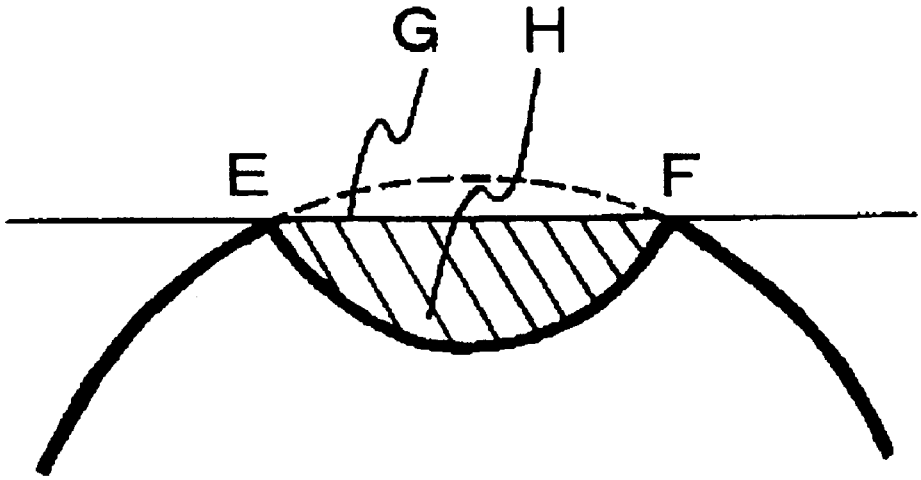
FIG. 1 is a schematic cross section of a dimple of the golf ball of the present invention used for explaining the method of measuring a total volume of the dimples.
Figure 2:
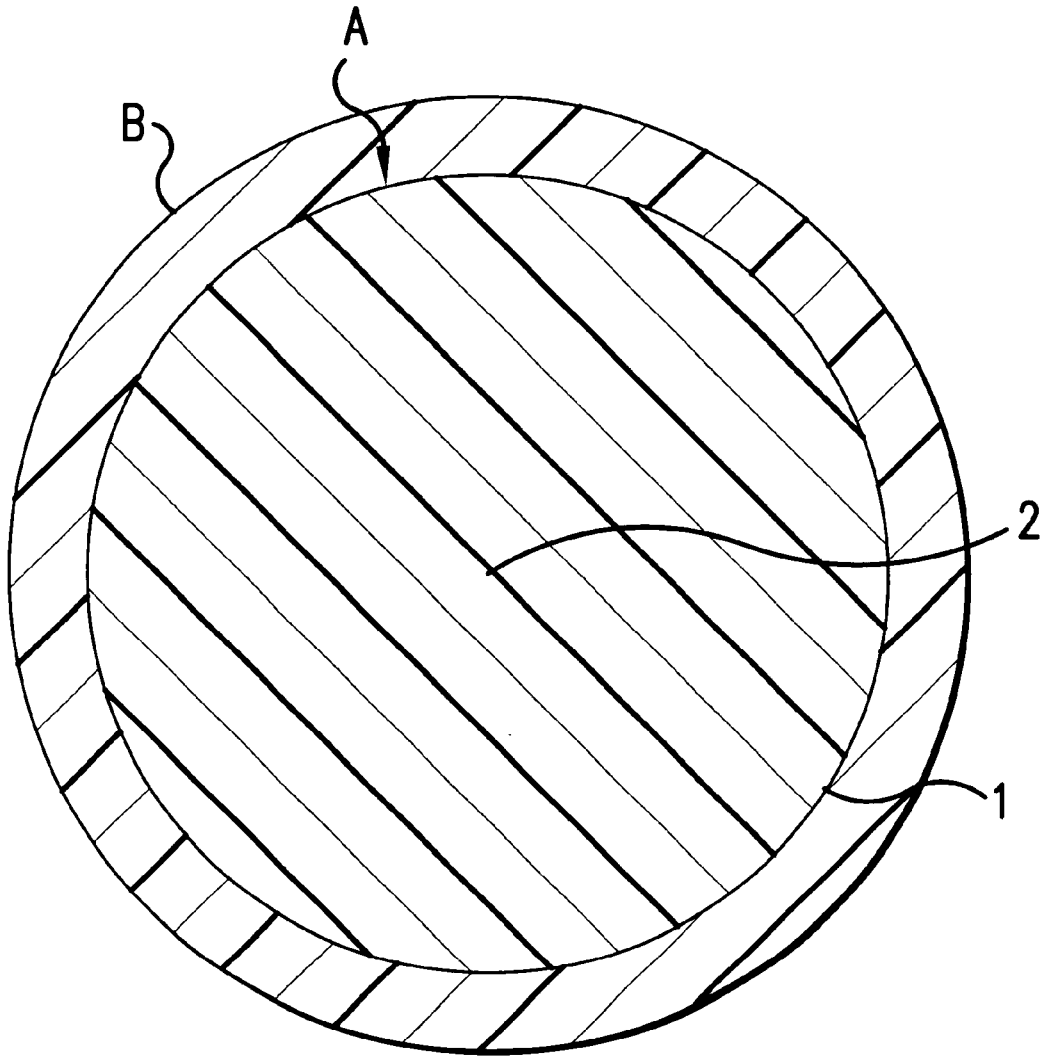
FIG. 2 is a view in cross section of a golf ball of the present invention, depicting core A and cover B.

The present invention provides a two-piece solid golf ball comprising a core and a cover covering the core, wherein

- a surface hardness in Shore D hardness of the core is higher than a center hardness in Shore D hardness of the core by 15 to 40,
- the cover is formed from a cover composition comprising
  - (a) 10 to 80 parts by weight of ethylene-(meth)acrylic acid copolymer ionomer resin,
  - (b) 0 to 60 parts by weight of ethylene-(meth)acrylic acid ester terpolymer ionomer resin, and
  - (c) 5 to 60 parts by weight of thermoplastic elastomer comprising styrene block, based on 100 parts by weight of a base resin,
- the cover has a Shore D hardness of 40 to 60, and
- the cover hardness is lower than the surface hardness of the core by 1 to 20.

In the golf ball of the present invention, the flight distance is long by optimizing the hardness difference between the surface and center point of the core to accomplish high launch angle and low spin amount when hit by a middle iron club to a driver; and a two-piece solid golf ball having long flight distance, large spin amount when hit by a short iron club and the like and excellent controllability, while maintaining good shot feel as good as thread wound golf ball is provided by employing a blend of thermoplastic elastomer having high rebound characteristics and ionomer resin in the cover, and adjusting the difference between the surface hardness of the core and cover hardness.

In order to put the present invention into a more suitable practical application, it is preferable that the cover have a thickness of 1.0 to 2.5 mm, and assuming that the cover hardness is represented by A and a total dimple volume is represented by B ($mm^3$), the product AB is within the range of 12,000 to 18,000;

the cover has a flexural modulus of 30 to 80 MPa; and the thermoplastic elastomer comprising styrene block is selected from the group consisting of polymer alloys of olefin; and styrene-butadiene-styrene block copolymer (SBS), styrene-isoprene-styrene block copolymer (SIS), styrene-isoprene-butadiene-styrene block copolymer (SIBS), or hydrogenation product thereof.

DETAILED DESCRIPTION OF THE INVENTION

The two-piece solid golf ball of the present invention comprises a core A and a cover B covering the core A. The core is obtained by press-molding a rubber composition under applied heat by using a method and condition, which has been conventionally used for preparing solid cores of golf balls. The rubber composition contains a base rubber, a co-crosslinking agent, an organic peroxide, a filler, an antioxidant and the like.

The base rubber used for the core of the present invention may be natural rubber and/or synthetic rubber, which has been conventionally used for cores of solid golf balls. Preferred is high-cis polybutadiene rubber containing a cis-1, 4 bond of not less than 40%, preferably not less than 80%. The high-cis polybutadiene rubber may be optionally mixed with natural rubber, polyisoprene rubber, styrene-butadiene rubber, ethylene-propylene-diene rubber (EPDM) and the like.

The co-crosslinking agent can be a metal salt of α,β-unsaturated carboxylic acid, including mono or divalent metal salts, such as zinc or magnesium salts of α,β-unsaturated carboxylic acids having 3 to 8 carbon atoms (e.g. acrylic acid, methacrylic acid, etc.). The preferred co-crosslinking agent is zinc acrylate, because it imparts high rebound characteristics to the resulting golf ball. The amount of the co-crosslinking agent is from 25 to 39 parts by weight, preferably from 27 to 37 parts by weight, based on 100 parts by weight of the base rubber. When the amount of the co-crosslinking agent is smaller than 25 parts by weight, the core is too soft, and the rebound characteristics are degraded, which reduces the flight distance. In addition, since the cover is formed from soft materials, the resulting golf ball is too soft, and the shot feel is poor. On the other hand, when the amount of the co-crosslinking agent is larger than 39 parts by weight, the core is too hard, and the shot feel of the resulting golf ball is poor.

The organic peroxide includes, for example, dicumyl peroxide, 1,1-bis (t-butylperoxy)-3,3,5-trimethylcyclohexane, 2,5-dimethyl-2,5-di(t-butylperoxy) hexane, di-t-butyl peroxide and the like. The preferred organic peroxide is dicumyl peroxide. The amount of the organic peroxide is from 0.5 to 2.0 parts by weight, preferably 0.7 to 1.5 parts by weight, based on 100 parts by weight of the base rubber. When the amount of the organic peroxide is smaller than 0.5 parts by weight, the core is too soft, and the rebound characteristics of the resulting golf ball are degraded, which reduces the flight distance. On the other hand, when the amount of the organic peroxide is larger than 2.0 parts by weight, the core is too hard, and the shot feel of the resulting golf ball is poor.

The filler, which can be typically used for the core of solid golf ball, includes for example, inorganic filler (such as zinc oxide, barium sulfate, calcium carbonate, magnesium oxide and the like), high specific gravity metal powder filler (such as tungsten powder, molybdenum powder and the like), and the mixture thereof. The amount of the filler is from 5 to 50 parts by weight, preferably from 8 to 40 parts by weight, based on 100 parts by weight of the base rubber. When the amount of the filler is smaller than 5 parts by weight, it is required to add a large amount of filler to the cover in order to adjust the weight of the resulting golf ball to a proper range. Therefore the rebound characteristics of the resulting golf ball are degraded. On the other hand, when the amount of the filler is larger than 50 parts by weight, it is difficult to adjust the weight of the resulting golf ball to a proper range.

The rubber compositions for the core of the golf ball of the present invention can contain other components, which have been conventionally used for preparing the core of solid golf balls, such as antioxidant or peptizing agent. If used, the amount of the antioxidant is preferably 0.2 to 1.0 parts by weight, based on 100 parts by weight of the base rubber.

The core of the golf ball of the present invention can be obtained by mixing the rubber composition, and then press-molding and vulcanizing the mixture under applied heat in a mold. The vulcanizing, of which the condition is not limited, is conducted at 130 to 180° C. and 2.9 to 9.8 MPa for 15 to 60 minutes.

In the golf ball of the present invention, the core has a diameter of 37 to 43 mm, preferably 38 to 42 mm, more preferably 39 to 41 mm. When the diameter of the core is smaller than 37 mm, it is required to increase the thickness of the cover in order to adjust the diameter of the resulting golf ball to diameter conformed to the regulations for golf balls. Therefore, the spin amount when hit by a driver is large, which reduces the flight distance. On the other hand, when the diameter of the inner core is larger than 43 mm, the diameter of the resulting golf ball is too large, and air resistance of the hit golf ball, which reduces the flight distance.

In the golf ball of the present invention, it is required for the core to have a surface hardness 1 higher than a center hardness 2 in Shore D hardness by 15 to 40, and the hardness difference is preferably 20 to 35, more preferably 20 to 30. When the hardness difference is smaller than 15, the spin amount at the time of hitting is high, which reduces the flight distance. On the other hand, when the hardness difference is larger than 40, the center hardness of the core is too low, and the rebound characteristics are degraded, which reduces the flight distance.

In the golf ball of the present invention, it is desired for the core to have the surface hardness in Shore D hardness of 45 to 70, preferably 49 to 60, more preferably 52 to 59, most preferably 54 to 58. When the hardness is lower than 45, the rebound characteristics of the resulting golf ball are degraded, which reduces the flight distance. In addition, the shot feel is too soft and poor. On the other hand, when the hardness is higher than 70, the core is too hard, and the shot feel is poor. In addition, the spin amount at the time of hitting is high, which reduces the flight distance. The term "a surface hardness of the core" as used herein refers to the hardness, which is determined by measuring a hardness at the surface of the resulting core.

In the golf ball of the present invention, it is desired for the core to have the center hardness in Shore D hardness of 20 to 40, preferably 22 to 38, more preferably 25 to 36. When the center hardness is lower than 20, the compression (deformation amount) of the core is too large and the resulting golf ball is too soft, and the shot feel is poor. On the other hand, when the center hardness is higher than 40, the compression of the core is too small and the resulting golf ball is too hard, and the shot feel is poor. The term "a center hardness of the core" as used herein refers to the hardness, which is determined by cutting the resulting core into two equal parts and then measuring a hardness at its center point in section.

The cover is then covered on the core. In the golf ball of the present invention, it is desired for the cover to have a thickness of 1.0 to 2.5 mm, preferably 1.2 to 2.3 mm, more preferably 1.4 to 2.0 mm. When the thickness of the cover is smaller than 1.0 mm, the spin amount when hit by a short iron club and the like is low, and the controllability is degraded. On the other hand, when the thickness is larger than 2.5 mm, the spin amount is high, which reduces the flight distance.

In the golf ball of the present invention, it is required for the cover to have a hardness in shore D hardness lower than the surface hardness of the core by 1 to 20, and the hardness difference is preferably 2 to 15, more preferably 3 to 12. When the hardness difference is smaller than 1, the cover is too hard, and the spin amount when hit by a short iron club and the like is low. In addition, the shot feel is hard and poor. On the other hand, when the hardness difference is larger than 20, the cover is too soft, and the spin amount when hit by a driver and the like is high, which reduces the flight distance.

In the golf ball of the present invention, it is required for the cover to have a Shore D hardness of 40 to 60, preferably 42 to 58, more preferably 45 to 55. When the cover hardness is lower than 40, the cover is too soft, and the spin amount when hit by a driver and the like is high, which reduces the flight distance. On the other hand, when the cover hardness is higher than 60, the cover is too hard, and the impact force at the time of hitting is large, which degraded the shot feel. In addition, the spin amount at approach shot is low, and the controllability is degraded.

In the golf ball of the present invention, it is desired for the cover to have a flexural modulus of 30 to 80 MPa, preferably 35 to 75 MPa, more preferably 40 to 70 MPa. When the flexural modulus of the cover is lower than 30 MPa, the cover is too soft, and the spin amount when hit by a driver and the like is high, which reduces the flight distance. On the other hand, when the flexural modulus of the cover is higher than 80 MPa, the cover is too hard, and the impact force at the time of hitting is large, which degraded the shot feel. In addition, the spin amount at approach shot is low, and the controllability is degraded.

In the golf ball of the present invention, it is required for the cover to be formed from a cover composition comprising (a) 10 to 80 parts by weight of ethylene-(meth)acrylic acid copolymer ionomer resin, (b) 0 to 60 parts by weight of ethylene-(meth)acrylic acid-(meth)acrylic acid ester terpolymer ionomer resin, and (c) 5 to 60 parts by weight of thermoplastic elastomer comprising styrene block.

In the golf ball of the present invention, the (a) component of the cover composition is ethylene-acrylic acid copolymer ionomer resin and/or ethylene-methacrylic acid copolymer ionomer resin. As a composition ratio of the ethylene to acrylic acid or methacrylic acid in the ionomer resin, it is preferable for the ionomer resin to comprise 70 to 95% by weight of the ethylene and 5 to 30% by weight of the acrylic acid or methacrylic acid. The ionomer resin is partially neutralized with metal salt, and crosslinked with metal ion. That is, at least a portion of carboxylic acid groups in the copolymer of ethylene and acrylic acid or methacrylic acid is neutralized and crosslinked with metal ion. Examples of the metal ion include alkaline metal ion, such as sodium ion, potassium ion, lithium ion and the like; divalent metal ion, such as zinc ion, calcium ion, magnesium ion and the like; trivalent metal ion, such as aluminum ion, neodymium ion and the like; and the mixture thereof. Preferred are sodium ion, zinc ion, lithium ion and the like, in view of rebound characteristics, durability and the like.

The (a) component is preferably high stiffness type ionomer resin having a Shore D hardness of 55 to 70, preferably 57 to 68, and a flexural modulus of 200 to 500 MPa, preferably 250 to 450 MPa.

Examples of the ionomer resin will be shown by a trade name thereof. Examples of the ionomer resin, which is commercially available from Mitsui Du Pont Polychemicals Co., Ltd. include Hi-milan 1555 (Na), Hi-milan 1557 (Zn), Hi-milan 1605 (Na), Hi-milan 1706 (Zn), Hi-milan 1707 (Na), Hi-milan AM7318 (Na), Hi-milan AM7315 (Zn), Hi-milan AM7317 (Zn), Hi-milan AM7311 (Mg) and Hi-milan MK7320 (K) and the like.

Examples of the ionomer resin, which is commercially available from Du Pont Co., include Surlyn 8945 (Na), Surlyn 8940 (Na), Surlyn 9910 (Zn), Surlyn 9945 (Zn), Surlyn 7930 (Li) and Surlyn 7940 (Li) and the like. Examples of the ionomer resin, which is commercially available from Exxon Chemical Co., include Iotek 7010 (Zn), Iotek 8000 (Na), Iotek 7030 (Zn), Iotek 8030 (Na) and the like.

Incidentally, Na, Zn, K, Li and Mg, which are described in parentheses after the trade name of the above ionomer resin, indicate their neutralizing metal ion species. These ionomer resins may be used alone or in combination of two or more thereof, or a mixture of one or more of the ionomer resin obtained by neutralizing with monovalent metal ion and the ionomer resin obtained by neutralizing with divalent metal ion, as the base resin of the cover in the present invention.

In the golf ball of the present invention, the (b) component of the cover composition is ethylene-acrylic acid or methacrylic acid-acrylic acid ester or methacrylic acid ester terpolymer ionomer resin. As a composition ratio thereof in the ionomer resin, it is preferable for the ionomer resin to comprise 70 to 85% by weight of the ethylene, 5 to 20% by weight of the (meth)acrylic acid and 10 to 25% by weight of the (meth)acrylic acid ester. Examples of the (meth)acrylic acid ester include methyl ester, ethyl ester, propyl ester, n-butyl ester, isobutyl ester and the like of acrylic acid or methacrylic acid. In the ionomer resin, at least a portion of carboxylic acid groups in the terpolymer is neutralized and crosslinked with metal ion as described in the component (a). Examples of the metal ion include the same as described in the component (a).

Examples of the terpolymer ionomer resin include Hi-milan 1856 (Na), Hi-milan 1855 (Zn), Hi-milan AM7316 (Zn) and the like, which is commercially available from Mitsui Du Pont Polychemicals Co., Ltd.; Surlyn 8320 (Na), Surlyn 9320 (Zn), Surlyn 6320 (Mg) and the like, which is commercially available from Du Pont Co.; Iotek 7510 (Zn), Iotek 7520 (Zn) and the like, which is commercially available from Exxon Chemical Co.

It is preferable for the (a) component to have a Shore D hardness of 30 to 55, preferably 35 to 50, and a flexural modulus of 10 to 100 MPa, preferably 15 to 80 MPa. It is the reason to easily obtain the technical effect of improving the compatibility with the (a) and (b) components.

In the golf ball of the present invention, it is required for the base resin of the cover to compound at least one thermoplastic elastomer comprising styrene block as the (c) component with the ionomer resin as the (a) and (b) components. The thermoplastic elastomer comprising styrene block includes block copolymers comprising styrene block and conjugated diene compound block. Examples of the conjugated diene compounds include butadiene, isoprene, 1,3-pentadiene, 2,3-dimethyl-1,3-butadiene and the like, or mixtures thereof. Preferred are butadiene, isoprene and combinations thereof.

Examples of the thermoplastic elastomer comprising styrene block as the (c) component include styrene-butadiene-styrene block copolymer (SBS); styrene-isoprene-styrene block copolymer (SIS); styrene-isoprene-butadiene-styrene block copolymer (SIBS); or hydrogenation product thereof. That is, the thermoplastic elastomer comprising styrene block as the (c) component may be the SBS or hydrogenation product thereof; the SIS or hydrogenation product thereof; or the SIBS or hydrogenation product thereof. As the hydrogenation product of the SBS, for example, styrene-ethylene-butylene-styrene block copolymer (SEBS) may be used. As the hydrogenation product of the SIS, for example, styrene-ethylene-propylene-styrene block copolymer (SEPS) may be used. As the hydrogenation product of the SIBS, for example, styrene-ethylene-ethylene-propylene-styrene block copolymer (SEEPS) may be used.

The thermoplastic elastomer comprising styrene block as the (c) component may be also polymer alloys of olefin; and styrene-butadiene-styrene block copolymer (SBS), the hydrogenation product of the SBS, styrene-isoprene-styrene block copolymer (SIS), the hydrogenation product of the SIS, styrene-isoprene-butadiene-styrene block copolymer (SIBS), or the hydrogenation product of the SIBS.

Examples of the thermoplastic elastomer comprising styrene block include styrene-butadiene-styrene block copolymer (SBS); styrene-ethylene-butylene-styrene block copolymer (SEBS), of which the double bond in the butadiene portion of the SBS is hydrogenated; styrene-isoprene-styrene block copolymer (SIS); styrene-ethylene-propylene-styrene block copolymer (SEPS), of which the double bond in the isoprene portion of the SIS is hydrogenated; styrene-isoprene-butadiene-styrene block copolymer (SIBS); styrene-ethylene-ethylene-propylene-styrene block copolymer (SEEPS), of which the double bond in the butadiene or isoprene portion of the SIBS; and modification thereof.

A styrene content in the SBS, SEBS, SIS and SEPS is within the range of 10 to 50% by weight, preferably 15 to 45% by weight, based on the weight of the copolymer. When the styrene content is smaller than 10% by weight, the thermoplastic elastomer is too soft, and the cut resistance is degraded. On the other hand, when the styrene content is larger than 50% by weight, the technical effect of softening the cover accomplished by compounding the thermoplastic elastomer with the ionomer resin as the (a) component is not sufficiently obtained. Therefore, the shot feel and controllability are degraded.

In the present invention, the SBS, the SEBS, the SIS and the SEPS may have epoxy groups in a portion of the block copolymer. The wording "styrene-butadiene-styrene block copolymer (SBS) containing epoxy groups" as used herein means block copolymer in which polybutadiene block containing epoxy groups is sandwiched by two polystyrene blocks, and may be the block copolymer, of which a portion or all of the double bonds in the polybutadiene portion is hydrogenated. The wording "styrene-isoprene-styrene block copolymer (SIS) containing epoxy groups" as used herein means block copolymer in which polyisoprene block containing epoxy groups is sandwiched by two polystyrene blocks, and may be the block copolymer, of which a portion or all of the double bonds in the polyisoprene portion is hydrogenated.

An epoxy group content in the epoxidized SBS or epoxidized SIS is within the range of 0.05 to 10% by weight, preferably 0.2 to 5% by weight, based on the weight of the copolymer. When the epoxy group content is smaller than 0.05% by weight, the reaction of the epoxy group with a free carboxyl group in the ionomer resin decreases, and the dispersibility of the epoxidized SBS or epoxidized SIS in the ionomer resin is degraded. Therefore the durability of the resulting golf ball is degraded. On the other hand, when the epoxy group content is larger than 10% by weight, the reaction of the epoxy group with a free carboxyl group in the ionomer resin increases, and the flowability is poor, which degrades the moldability of the golf ball.

Examples of the epoxidized SBS or epoxidized SIS include styrene-butadiene-styrene block copolymer (SBS) comprising polybutadiene block containing epoxy groups commercially available from Daicel Chemical Industries, Ltd. under the trade name of "Epofriend" (such as "Epofriend A1010" and the like). Examples of the SEBS or SEPS having terminal OH groups are commercially available from Kuraray Co., Ltd. under the trade name of "Septon" (such as "Septon HG-252").

The inventors of the present invention discovered that the resulting golf ball has excellent physical properties of the cover and excellent ball performance, particularly high coefficient of restitution by employing polymer alloys of olefin; and styrene-butadiene-styrene block copolymer (SBS), the hydrogenation product of the SBS, styrene-isoprene-styrene block copolymer (SIS), the hydrogenation product of the SIS, styrene-isoprene-butadiene-styrene block copolymer (SIBS), or the hydrogenation product of the SIBS, in the thermoplastic elastomer comprising styrene block as the (c) component of the cover. It is considered as one of the reasons that the olefin component, which comprises the polymer alloy, contributes to the compatibility with the cover composition. The particularly preferred polymer alloy is polymer alloy of hydrogenated SBS (SEBS) commercially available from Shell Chemical Co. as a base polymer and the other polymer, which is blended at the molecular level. The preferred other polymer is polyolefins formed by polymerizing olefins having 2 to 10 of carbon atoms. Examples thereof include the polymer alloy commercially available from Mitsubishi Chemical Co., Ltd. under the trade name of "RABALON" (such as "RABALON SJ4400N", "RABALON SJ5400N", "RABALON SJ6400N", "RABALON SJ7400N", "RABALON SJ8400N", "RABALON SJ9400N", "RABALON SR04" and the like).

It is desired for the thermoplastic elastomer comprising styrene block as the (c) component to have a Shore A hardness of not more than 95, preferably not more than 80. When the hardness is larger than 95, it is difficult to soften the cover.

In the golf ball of the present invention, it is required for the cover composition to comprise 10 to 80 parts by weight of the (a) component, 0 to 60 parts by weight of the (b) component and 5 to 60 parts by weight of the (c) component, based on 100 parts by weight. The amount of the (a) component is preferably 20 to 70 parts by weight, more preferably 30 to 60 parts by weight. The amount of the (b) component is preferably 5 to 50 parts by weight, more preferably 10 to 40 parts by weight. The amount of the (c) component is preferably 10 to 50 parts by weight, more preferably 15 to 40 parts by weight. The (a) to (c) components has good compatibility by blending them at the above composition ratio, and they can be blended at the molecular level to form so-called polymer alloy. Therefore excellent physical properties such hardness, strength and impact resilience, which have not obtained by conventional blend system, can be obtained. In the result, it is possible to soften the cover, while maintaining excellent stiffness and impact resilience from the (a) component. Therefore, the shot feel, spin performance (controllability) and abrasion resistance of the resulting golf ball can be improved.

In the golf ball of the present invention, the (b) component is not essential component in the cover, but the compatibility of the (a) and (c) components is improved by comprising the (b) component in the cover composition at the above composition ratio. In addition, it is possible to soften the cover, while maintaining excellent strength and impact resilience. Therefore the spin performance and shot feel are further improved.

In the golf ball of the present invention, the cover composition may optionally contain other thermoplastic elastomer in addition to the base resin. The amount of the other thermoplastic elastomer is not more than 10 parts by weight, preferably 1 to 8 parts by weight, based on the 100 parts by weight of the base resin. When the amount is larger than 10 parts by weight, the compatibility of each material in the cover composition is degraded, and the abrasion resistance is poor. Examples of the other thermoplastic elastomers include polyolefin-based thermoplastic elastomer, polyurethane-based thermoplastic elastomer, polyester-based thermoplastic elastomer, and mixtures thereof.

Concrete examples of the other thermoplastic elastomer include polyolefin-based thermoplastic elastomer, which is commercially available from Mitsui Chemical Co., Ltd. under the trade name of "Milastomer" (such as "Milastomer M4800NW"); polyolefin-based thermoplastic elastomer, which is commercially available from Sumitomo Chemical Co., Ltd. under the trade name of "Sumitomo TPE" (such as "Sumitomo TPE3682" and "Sumitomo TPE9455"); polyurethane thermoplastic elastomer, which is commercially available from Kuraray Co., Ltd. under the trade name of "Kuramilon" (such as "Kuramilon 9195" and "Kuramilon 9180"); polyurethane-based thermoplastic elastomer, which is commercially available from Takeda Bardishe Co., Ltd. under the trade name of "Elastollan" (such as "Elastollan ET880" and "Elastollan ET890"); polyester-based thermoplastic elastomer, which is commercially available from Toray-Du Pont Co., Ltd. under the trade name of "Hytrel" (such as "Hytrel 4047", "Hytrel 4767", "Hytrel 5557"); and the like.

In the golf ball of the present invention, the cover composition may optionally contain fillers (such as barium sulfate, calcium carbonate etc.), pigments (such as titanium dioxide, etc.), and other additives (such as a dispersant, an antioxidant, a UV absorber, a photostabilizer and a fluorescent agent or a fluorescent brightener, etc.), in addition to the resin component, as long as the addition of the additive does not deteriorate the desired performance of the golf ball cover. If used, the amount of the pigment is preferably 0.1 to 5.0 parts by weight, based on the 100 parts by weight of the base resin of the cover.

The cover of the present invention may be formed by conventional methods, which have been known to the art and used for forming the cover of the golf balls. For example, there can be used a method comprising molding the cover composition into a semi-spherical half-shell in advance, covering the thread wound core with the two half-shells, followed by pressure molding at 130 to 170° C. for 1 to 5 minutes, or a method comprising injection molding the cover composition directly on the thread wound core to cover it. At the time of molding the cover, many depressions called "dimples" are formed on the surface of the golf ball.

In the golf ball of the present invention, assuming that the cover hardness in Shore D hardness is represented by A and a total dimple volume is represented by B ($mm^3$), it is desired for the product AB to be within the range of 12,000 to 18,000, preferably 13,000 to 17,500, more preferably 14,000 to 17,000. When the product AB is smaller than 12,000, the resulting golf ball creates blown-up trajectory, which reduces the flight distance. On the other hand, when the product AB is larger than 18,000, the trajectory of the resulting golf ball is too low, and the trajectory is easy to drop, which reduces the flight distance.

It is desired for the total dimple volume (B) to be within the range of 250 to 400 $mm^3$, preferably 300 to 380 $mm^3$, more preferably 320 to 360 $mm^3$. When the total dimple volume is smaller than 250 $mm^3$, the resulting golf ball creates blown-up trajectory, which reduces the flight distance. On the other hand, when the total dimple volume is larger than 400 $mm^3$, the trajectory of the resulting golf ball is too low, and the trajectory is easy to drop, which reduces the flight distance.

Furthermore, paint finishing or marking with a stamp may be optionally provided after the cover is molded for commercial purposes.

EXAMPLES

The following Examples and Comparative Examples further illustrate the present invention in detail but are not to be construed to limit the scope of the present invention.

Production of Core

The rubber compositions for the core having the formulations shown in Table 1 were mixed with a mixing roll, and then vulcanized by press-molding at the vulcanization condition shown in the same Table to obtain spherical cores having a diameter of 39.0 mm and weight of 36.6 g. The surface hardness (C) and center hardness (D) of the resulting core were measured, and the hardness difference (C–D) was determined by calculation. The results are shown in the same Table. The test methods are described later.

TABLE 1

| | (parts by weight) | | | |
|---|---|---|---|---|
| Core composition | i | ii | iii | iv |
| BR11 *1 | 100 | 100 | 100 | 100 |
| Zinc acrylate | 33 | 33 | 37 | 40 |

TABLE 1-continued

| Core composition | (parts by weight) i | ii | iii | iv |
|---|---|---|---|---|
| Zinc oxide | 17.8 | 17.8 | 16.4 | 15.3 |
| Dicumyl peroxide | 0.9 | 0.9 | 0.9 | 0.9 |
| Diphenyl disulfide | 0.5 | 0.5 | 0.5 | 0.5 |
| Vulcanization temperature (° C.) | 170 | 150 | 170 | 170 |
| Vulcanization time (min) | 20 | 25 | 15 | 12 |
| Surface hardness C (Shore D) | 55 | 49 | 57 | 60 |
| Center hardness D (Shore D) | 28 | 35 | 34 | 36 |
| Hardness difference (C-D) | 27 | 14 | 23 | 24 |

*1: High-cis Polybutadiene rubber (trade name "BR11") available from JSR Co., Ltd. (Content of 1,4-cis-polybutadiene: 96%)

Preparation of Cover Compositions

The formulation materials shown in Table 2 were mixed using a kneading type twin-screw extruder to obtain pelletized cover compositions. The extrusion condition was, a screw diameter of 45 mm, a screw speed of 200 rpm, and a screw L/D of 35.

The formulation materials were heated at 150 to 220° C. at the die position of the extruder. The Shore D hardness and flexural modulus were determined, using a sample of a stack of the three or more heat and press molded sheets having a thickness of about 2 mm from the resulting composition. The results are shown in the same Table. The test methods are described later.

TABLE 2

| Cover compsition | (parts by weight) I | II | III | IV |
|---|---|---|---|---|
| Hi-milan 1605 *2 | 40 | 40 | 50 | 20 |
| Hi-milan 1706 *3 | — | 10 | 50 | 20 |
| Surlyn 6320 *4 | 30 | 30 | — | 10 |
| RABALON SJ7400N *5 | 30 | — | — | — |
| RABALON SR04 *6 | — | 20 | — | 50 |
| Titanium dioxide | 4 | 4 | 4 | 4 |
| Cover hardness (Shore D) | 45 | 49 | 64 | 38 |
| Cover flexural modulus (MPa) | 45 | 56 | 320 | 29 |

*2: Hi-milan 1605 (trade name), ethylene-methacrylic acid copolymer ionomer resin obtained by neutralizing with sodium ion, manufactured by Mitsui Du Pont Polychemical Co., Ltd., Shore D hardness: 61, flexural modulus: about 295 MPa

*3: Hi-milan 1706 (trade name), ethylene-methacrylic acid copolymer ionomer resin obtained by neutralizing with zinc ion, manufactured by Mitsui Du Pont Polychemical Co., Ltd., Shore D hardness: 60, flexural modulus: about 270 MPa

*4: Surlyn 6320 (trade name), ethylene-methacrylic acid-acrylic acid ester terpolymer ionomer resin obtained by neutralizing with magnesium ion, manufactured by Du Pont Co., Shore D hardness: 44, flexural modulus: about 35 MPa

*5: RABALON SJ7400N (trade name), styrene-ethylene-butylene-styrene block copolymer (SEBS)-based thermoplastic elastomer, manufactured by Mitsubishi Chemical Co., Ltd., Shore A hardness: 75

*6: RABALON SR04 (trade name), SEBS-based thermoplastic elastomer, manufactured by Mitsubishi Chemical Co., Ltd., Shore A hardness: 40

Examples 1 to 4 and Comparative Examples 1 to 3

The cover compositions were covered on the resulting core by injection molding to form a cover layer having a thickness of 1.9 mm. Then, paint was applied on the surface to produce golf ball having a diameter of 42.8 mm and weight of 45.4 g. With respect to the resulting golf balls, the total dimple volume B ($mm^3$), flight performance (initial velocity, spin amount and flight distance) and shot feel were measured or evaluated. The product AB was determined by calculating from the cover hardness (A) and total dimple volume (B). The results are shown in Table 3 (Examples) and Table 4 (Comparative Examples). The test methods are as follows.

Test Method (1) Core Hardness

Shore D hardness was measured at the center point and surface of the core. The surface hardness (C) of the core was determined by measuring a hardness at the surface of the resulting core. The center hardness (D) of the core was determined by cutting the resulting core into two equal parts and then measuring a hardness at its center point in section. The Shore D hardness was measured using a Shore D hardness meter according to ASTM D 2240-68.

(2) Cover Hardness

The cover hardness was determined by measuring a hardness, using a sample of a stack of the three or more heat and press molded sheets having a thickness of about 2 mm from the cover composition, which had been stored at 23° C. for 2 weeks, with a Shore D hardness meter according to ASTM D 2240.

(3) Flexural Modulus of the Cover

The flexural modulus of the cover was determined by measuring a flexural modulus according to JIS K7106, using a sample of a stack of the three or more heat and press molded sheets having a thickness of about 2 mm from the cover composition, which had been stored at 23° C. for 2 weeks.

(4) Total Dimple Volume

With respect to "m" types of dimples on the surface of the golf ball, a dimple shape in section is measured using a pick-up type (contact type) of profile meter, and the volumes of each type of dimple, $v_1$, to $v_m$ are obtained by calculating from the shape. The total volume of dimples B determined by calculating from the volumes ($v_1$ to $v_m$) and the numbers ($n_1$ to $n_m$) of each type of dimple, according to the following formula:

$$B=v_1n_1+v_2n_2+v_3n_3+v_4n_4 \ldots +v_mn_m$$

If the golf ball has four types of dimples (m=4), the total volume of dimples B is represented by the following formula:

$$B=v_1n_1+v_2n_2+v_3n_3+v_4n_4$$

The volume of each dimple is determined by tracing the bottom portion of the dimple measured, forming a chart from one edge E to other edge F of the dimple as described in FIG. 1, plotting each point from E to F from the chart, drawing a tangent line G through the points E and F as described in FIG. 1, and calculating the volume of the portion H, which is enclosed by the tangent line G and the bottom of the dimple.

(5) Flight Performance (5-1) Flight Performance 1

After a No.1 wood club (W#1, a driver) was mounted to a swing robot manufactured by Golf Laboratory Co. and the golf ball was hit at a head speed of 50 m/sec, the initial velocity, spin amount and flight distance were measured. As the flight distance, total that is a distance to the stop point of the hit golf ball was measured. The measurement was conducted by using 12 golf balls for every sample (n=12), and the average is shown as the result of the golf ball.

(5-2) Flight Performance 2

After a sand wedge (SW) was mounted to a swing robot manufactured by Golf Laboratory Co. and the golf ball was hit at a head speed of 21 m/sec, the spin amount was measured. The spin amount was measured by continuously taking a photograph of a mark provided on the hit golf ball using a high-speed camera. The measurement was conducted 12 golf balls for each sample (n=12), and the average is shown as the result of the golf ball.

(6) Shot Feel

The resulting golf balls were evaluated by 10 golfers according to practical hitting test using a No.1 wood club (W#1, a driver) by counting the number of golfers, who felt that the golf ball has good shot feel such that the impact force is small and rebound characteristics are good. The evaluation criteria are as follows.

Evaluation Criteria

○: Not less than 8 out of 10 golfers felt that the golf ball has soft and good shot feel.

Δ: 7 to 3 out of 10 golfers felt that the golf ball has soft and good shot feel.

x: Not less than 8 out of 10 golfers felt that the golf ball has hard and poor shot feel.

TABLE 3

| Example No. | 1 | 2 | 3 | 4 |
|---|---|---|---|---|
| (Core) | | | | |
| Composition | i | iii | i | i |
| Shore D hardness | | | | |
| Surface hardness (C) | 55 | 57 | 55 | 55 |
| Center hardness (D) | 28 | 34 | 28 | 28 |
| Hardness difference (C-D) | 27 | 23 | 27 | 27 |
| (Cover) | | | | |
| Composition | II | I | I | II |
| Hardness A (Shore D) | 49 | 45 | 45 | 49 |
| Flexural modulus (MPa) | 56 | 45 | 45 | 56 |
| Total dimple volume B ($mm^3$) | 330 | 350 | 250 | 400 |
| Product (AB) | 16170 | 15750 | 11250 | 19600 |
| Hardness difference (C-A) | 6 | 12 | 10 | 6 |
| (Golf ball) | | | | |
| Flight performance (1); W#1, 50 m/sec | | | | |
| Initial velocity (m/sec) | 65.1 | 65.0 | 64.9 | 65.1 |
| Spin amount (rpm) | 2750 | 2880 | 2840 | 2750 |
| Total (m) | 232.8 | 232.0 | 230.2 | 229.8 |
| Flight performance (2); SW, 21 m/sec | | | | |
| Spin amount (rpm) | 6880 | 6950 | 6860 | 6870 |
| Shot feel | ○ | ○ | ○ | ○ |

TABLE 4

| Comparative Example No. | 1 | 2 | 3 |
|---|---|---|---|
| (Core) | | | |
| Composition | ii | i | iv |
| Shore D hardness | | | |
| Surface hardness (C) | 49 | 55 | 60 |
| Center hardness (D) | 35 | 28 | 36 |
| Hardness difference (C-D) | 14 | 27 | 24 |

TABLE 4-continued

| Comparative Example No. | 1 | 2 | 3 |
|---|---|---|---|
| (Cover) | | | |
| Composition | I | III | IV |
| Hardness A (Shore D) | 45 | 64 | 38 |
| Flexural modulus (MPa) | 45 | 320 | 29 |
| Total dimple volume B ($mm^3$) | 350 | 330 | 330 |
| Product (AB) | 15750 | 21120 | 12540 |
| Hardness difference (C-A) | 4 | −9 | 22 |
| (Golf ball) | | | |
| Flight performance (1); W#1, 50 m/sec | | | |
| Initial velocity (m/sec) | 65.2 | 65.3 | 65.0 |
| Spin amount (rpm) | 3030 | 2510 | 3080 |
| Total (m) | 228.5 | 232.5 | 227.0 |
| Flight performance (2); SW, 21 m/sec | | | |
| Spin amount (rpm) | 7050 | 4500 | 7180 |
| Shot feel | Δ | x | ○ |

As is apparent from Tables 3 and 4, the golf balls of Examples 1 to 4 of the present invention, when compared with the golf balls of Comparative Examples 1 to 3, had good shot feel, long flight distance when hit by a driver, and large spin amount when hit by a short iron club and the like (sand wedge) and excellent controllability.

In the golf ball of Example 3, which is within the scope of the present invention, the above properties are superior to the golf balls of Comparative Examples, but the product AB of the cover hardness A by the total dimple volume B is small, and the resulting golf ball is easy to create blown-up trajectory, which slightly reduces the flight distance. In the golf ball of Example 4, which is within the scope of the present invention, the above properties are superior to the golf balls of Comparative Examples, but the product AB is large, the trajectory of the resulting golf ball is too low, and the trajectory is easy to drop, which slightly reduces the flight distance.

On the other hand, in the golf ball of Comparative Example 1, since the hardness difference (C−D) between the surface hardness (C) and center hardness (D) of the core is small, the spin amount at the time of hitting is high, which reduces the flight distance.

In the golf ball of Comparative Example 2, since the hardness difference (C−A) between the surface hardness (C) of the core and the cover hardness (A) is small, the cover is too hard, and the spin amount when hit by a sand wedge is low, which degrades the controllability.

In the golf ball of Comparative Example 3, since the hardness difference (C−A) is large, the cover is too soft, and the spin amount when hit by a driver is high, which reduces the flight distance.

What is claimed is:

1. A two-piece solid golf ball comprising a core and a cover covering the core, wherein a surface hardness in Shore D hardness of the core is higher than a center hardness in Shore D hardness of the core by 15 to 40, the cover is formed from a cover composition comprising (a) 10 to 80 parts by weight of ethylene-(meth)acrylic acid copolymer ionomer resin, (b) 0 to 60 parts by weight of ethylene-(meth)acrylic acid-(meth)acrylic acid ester terpolymer ionomer resin, and (c) 5 to 60 parts by weight of thermoplastic elastomer comprising styrene block, based on 100 parts by weight of a base resin, the cover has a Shore D hardness of 40 to 60, the cover hardness is lower than the surface hardness of the core by 1 to 20, wherein the cover has a thickness of 1.4 to 2.0 mm, and when the cover hardness is represented by A and a total dimple volume is represented by B ($mm^3$), the product AB is within the range of 12,000 to 18,000.

2. The two-piece solid golf ball according to claim 1, wherein the cover has a flexural modulus of 30 to 80 MPa.

3. The two-piece solid golf ball according to claim 1, wherein the thermoplastic elastomer comprising styrene block is selected from the group consisting of polymer alloys of olefin; and styrene-butadiene-styrene block copolymer (SBS), styrene-isoprene-styrene block copolymer (SIS), styrene-isoprene-butadiene-styrene block copolymer (SIBS), or hydrogenation product thereof.

* * * * *